United States Patent [19]

Bahrenburg

[11] Patent Number: 4,905,810

[45] Date of Patent: Mar. 6, 1990

[54] ROTOR SHAFT TURNING APPARATUS

[76] Inventor: Harry H. Bahrenburg, 11 Sherman Ct., Bethpage, N.Y. 11714

[21] Appl. No.: 361,654

[22] Filed: Jun. 5, 1989

Related U.S. Application Data

[62] Division of Ser. No. 187,862, Apr. 29, 1988.

[51] Int. Cl.[4] ..... B60K 41/28

[52] U.S. Cl. ..... 192/0.092; 74/125.5; 60/39.091; 318/12

[58] Field of Search ..... 192/0.092 R; 74/125.5; 60/39.091; 318/11, 12

[56] References Cited

U.S. PATENT DOCUMENTS

| | | | |
|---|---|---|---|
| 2,129,529 | 2/1938 | Howard | 415/134 |
| 2,252,456 | 8/1941 | Buehman | 415/20 |
| 2,617,253 | 11/1952 | Fosner et al. | 60/39.091 |
| 3,146,910 | 9/1964 | Varner | 222/55 |
| 3,321,982 | 5/1967 | Maunus et al. | 74/84 R |
| 3,753,481 | 8/1973 | Piola et al. | 192/142 R |
| 4,003,200 | 1/1977 | Zerlauth | 60/39.02 |
| 4,018,094 | 4/1977 | Schmidt | 74/126 |
| 4,090,409 | 5/1978 | Ohleyer | 74/128 |
| 4,249,371 | 2/1981 | Romeyke | 60/39.04 |
| 4,267,740 | 5/1981 | Schwarz | 74/128 |
| 4,507,926 | 4/1985 | Teckentrup et al. | 60/656 |
| 4,643,637 | 2/1987 | Strickler | 74/142 |

*Primary Examiner*—Rodney H. Bonck
*Assistant Examiner*—Nicholas Whitelaw
*Attorney, Agent, or Firm*—Brooks Haidt Haffner & Delahunty

[57] ABSTRACT

Apparatus and method for periodic rotation of the rotor assembly of a turbogenerator during the time that it is not rotated in its normal manner for generating power, in which a continuously operating motor is periodically connected through an electrically controllable, torque-speed, clutch mechanism and a gear train to a gear mounted on the rotor shaft so as to rotate the shaft by 180° at a slow speed. The position of the rotor is measured by electrically counting the teeth of the gear on the rotor shaft, and the count of teeth is compared with a preset number in a counter which after the count set in the counter is reached, disconnects the motor from the rotor gear and sets a brake. A settable timer periodically releases the brake and connects the motor to the rotor gear. The apparatus can include a recorder for recording rotation of the shaft and an alarm for indicating failure of rotation of the rotor when the timer provides a start signal.

7 Claims, 1 Drawing Sheet.

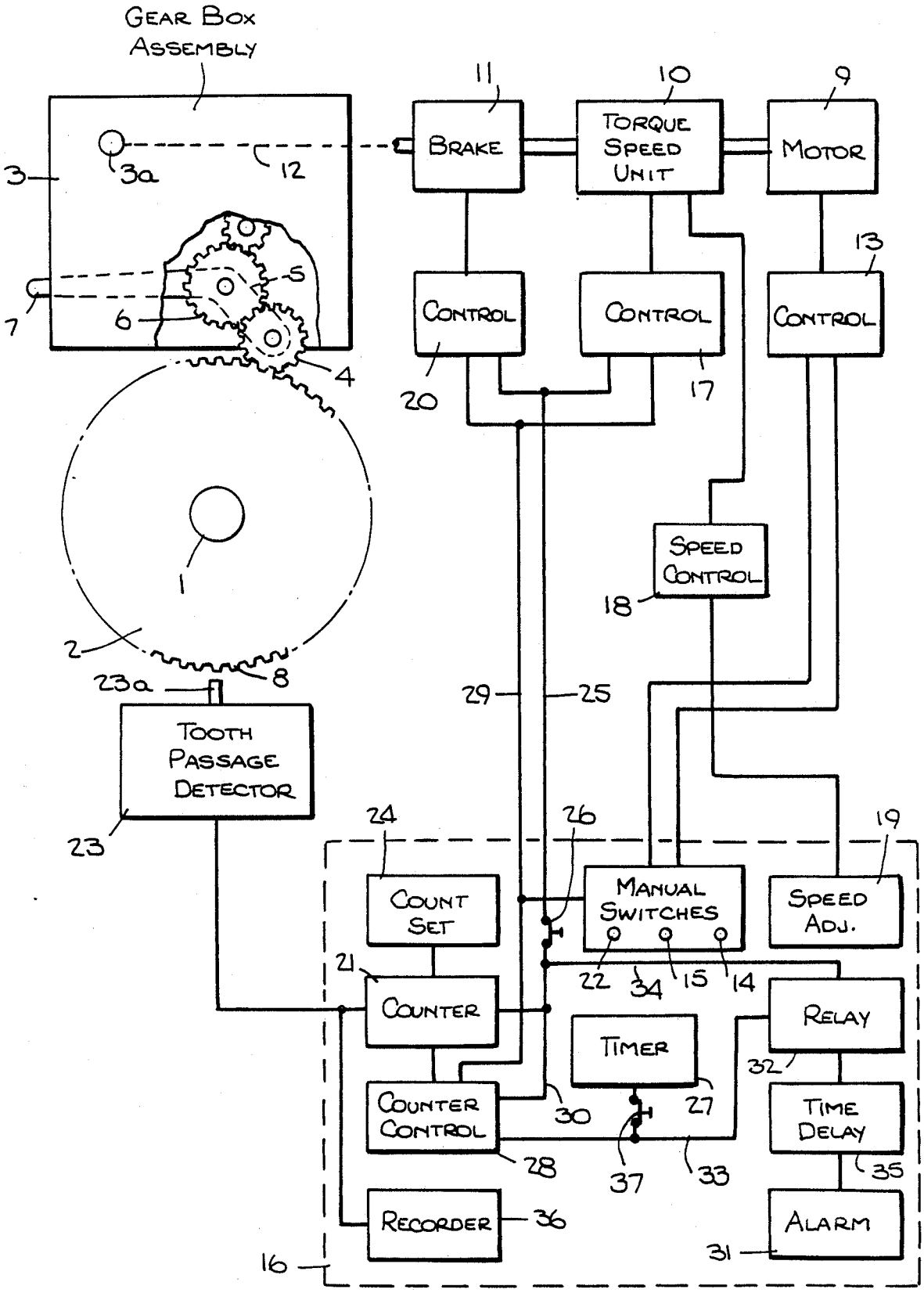
Gear Box Assembly
Brake
Torque Speed Unit
Motor
Control
Control
Control
Speed Control
Tooth Passage Detector
Count Set
Manual Switches
Speed Adj.
Counter
Relay
Timer
Counter Control
Time Delay
Recorder
Alarm

ROTOR SHAFT TURNING APPARATUS

This is a division of application Ser. No. 187,862, filed Apr. 29, 1988.

BACKGROUND OF THE INVENTION

This invention relates to a method and apparatus for programmable, periodic rotation of a rotatable member and particularly, to periodic rotation of the rotor assembly of a turbogenerator during the time that it is not rotated in its normal manner for generating power.

It is known in the art that it is beneficial to rotate a rotor of a machine, particularly a massive rotor which is subjected to thermal gradients during and following normal operation. This rotational function is begun after the rotor has been at rest for a relatively short period of time in order to prevent distortion of the rotor shaft. See, for example, U.S. Pat. Nos. 4,018,094; 4,090,409; 4,267,740 and 4,643,637. However, the turbogenerator rotor, when rotated continuously at low speed during cooldown or for other assignments, incurs possible fretting corrosion on the generator rotor, and low cycle fatigue stresses on the low pressure turbine rotor.

It is sometimes necessary to position the rotor shaft accurately for maintenance purposes, such as blade or seal inspection, rotor balancing activity or rotor positioning at start-up of the rotor for normal operation. If the rotor shaft is turned by an electric motor, as in U.S. Pat. No. 4,643,637, the motor is frequently turned on and off in a short time span, or "jogged", to accomplish the positioning of the rotor shaft. The positioning of the rotor shaft by such method depends on many things, including the skill of the operator, and the electric motor is not only strained by such activity but also has a shorter life. To reduce such problems, it has sometimes been the practice not to use the electric motor for jogging purposes, and instead, to wrap the rotor shaft with a cable and to pull the cable with a hoist.

Ratchet type rotor shaft rotating devices of the type disclosed in some of the patents identified hereinbefore utilize a ratchet mechanism subject to ratchet wheel tooth breakage and pawl problems where then it is necessary to dismantle the machine of which the rotor shaft forms a part for repair, or to forego the turning of the rotor shaft. Further, rotor balance problems can develop from such incidences.

SUMMARY OF THE INVENTION

One object of the invention is to overcome the problems of the prior art rotor shaft rotating devices.

I have found that it is sufficient, in order to overcome the turbine low cycle fatigue stress problems and the generator rotor fretting problems, to periodically rotate the rotor shaft by means of a bull gear on the rotor shaft at a low speed between two rotor positions 180° apart. However, to accomplish such results, the apparatus of my invention includes means for measuring the amount of rotation of the shaft and means responsive thereto for stopping the rotation of the shaft.

In addition, the preferred apparatus of my invention includes a drive means which is continuously operating when the shaft to be indexed is stopped, and which is coupled to such shaft by a controllable torque transmission device which is controlled either manually or automatically to cause rotation of the shaft to the selected position.

BRIEF DESCRIPTION OF THE DRAWING

Other objects and advantages of the present invention will be apparent from the following detailed description of the presently preferred embodiments thereof, which description should be considered in conjunction with the accompanying drawing, the single figure of which illustrates schematically a preferred embodiment of the invention.

DETAILED DESCRIPTION OF PREFERRED EMBODIMENTS

In the drawing a rotor shaft 1, such as the rotor shaft of a steam driven turbogenerator, has secured thereto a relatively large and sturdy gear 2, sometimes known as a "bull" gear, which rotates with the shaft 1.

The drawing also illustrates schematically a prior art gear box assembly 3 which has a rotatable input shaft 3*a* and a gear train which form part of the driving means for the rotor shaft 1. The assembly may be of any desired type, such as a turning device assembly manufactured by the General Electric Co. The assembly has an output gear which is rotated when the input shaft 3*a* of the assembly is rotated and which is mounted on an arm 5. The arm 5 is pivotable about the axis of a gear 6 by a lever 7 so that the teeth of the gear 4 will mesh with or be disengaged from the teeth 8 of the gear 2 with movement of the lever 7. Thus, when the teeth of the gear 4 engage the teeth 8 and the gear 4 is rotated, the gear 2 is rotated.

In the prior art, the input shaft 3*a* of the assembly 3 is connected directly to the output shaft of an electric motor, such as the electric motor 9. With this on-off arrangement, the motor 9 is maintained in continuous operation, and the rotor shaft 1 is rotated continuously at a relatively low speed, e.g. 2–3 rpm, which has the disadvantages described hereinbefore.

In accordance with the invention, after the rotor shaft 1 has come to rest, the input shaft of the assembly 3 is driven periodically by the motor 9 so that the shaft 1 is rotated through 180° at spaced intervals such as every 15–30 minutes and preferably is rotated every 20 minutes at a programmable variable speed up to 2–3 rpm between two positions 180° apart. To accomplish such rotation, I combine programming, counting, timing and other apparatus in a manner which provides such periodic rotation of the rotor shaft 1 and which precisely positions the shaft 1 in such positions.

Preferably, also, the motor 9 continuously operates when the system is in the periodic rotation condition so that it is not activated only when the shaft 1 is to be rotated to such positions, but the input shaft 3*a* of the assembly 3 is connected to the motor 9 by clutch means in the form of a torque-speed clutch mechanism forming part of the driving means for the rotor shaft 1.

In the preferred embodiment illustrated schematically in the drawing, the motor 9 drives a torque/speed clutch unit 10 connected to an electrically operable brake 11 and to the input shaft 3*a* as indicated by the dashed line 12. The motor 9 has a conventional electrically operable control 13 which will energize the motor 9 when a switch, such as the manually operable switch 14, is operated. The motor 9 can be stopped by operation of the switch 15. The switches 14 and 15, as well as other components hereinafter identified, may be located at a control console 16 remote from the driving and driven components and indicated by the dashed lines.

Although other types of variable output speed clutches for drivingly interconnecting the motor 9 with the input shaft 3a can be used, preferably, the motor 9 is interconnected with the shaft 3a by a torque/speed unit 10, such as the eddy current drive sold by U.S. Electrical Motors, Milford, Conn., or by a hydrostatic speed variator sold by Dana Corporation, Toledo, Ohio. In accordance with the preferred embodiment, the motor 9 operates continuously and operates the gear box assembly 3 periodically, and therefore, the function of the unit 10 is to permit the output shaft of the motor 9 to rotate the shaft 3a when scheduled but to permit the motor 9 to continue to operate when the shaft 3a is not rotating.

The clutch unit 10 is controlled by a control 17 which is electrically operable and causes the torque of the output shaft of the motor 9 to be either transmitted, or not transmitted, to the input shaft 3a of the gear box assembly 3. The unit 10 also has a speed control 18 which determines the rotational speed of the output shaft thereof and determines the speed of rotation of the input shaft 3a. Preferably, the rotational speed of the shaft 3a is set by the speed adjuster 19 at the remote console 16 so that the speed of rotation of the shaft 1, during the rotation thereof between two positions 180° apart, is from a fractional rpm up to 2–3 rpm.

Although not required, it is preferable that a conventional brake 11 which is operable by an electrically operable control 20 be provided to stop and hold the shaft 1 in the position determined by a known type of settable counter 21 as described hereinafter. The control 20 is also operable by a manual switch 22.

The input of the counter 21 is connected to a rotation sensing means in the form of a known type of tooth counter 23 having a tooth sensor 23a adjacent to the teeth 8 of the gear 2. The tooth counter 23 provides electrical pulses, one for each tooth passing by the sensor 23a to the counter 21 which, after receiving a number of electrical pulses determined by the count set control 24, provides an electrical output signal which is transmitted by a line 25 (with the switch 26 closed) to the controls 17 and 20 to slow and stop rotation of the input shaft 3a, and hence, the rotor shaft 1, and to set the brake 11.

Initiation of the rotation of the shaft 1 is caused by a known type of timing means or timer 27 connected to the counter control 28. Thus, the timer 27, which may, for example, momentarily close an electrical circuit for the counter control 28 every 20 minutes, causes energization of the counter 21 and the transmission of an electrical signal by way of a line 29 to the controls 17 and 20 to start rotation of the shaft 3a and release of the brake 11. Accordingly, the programmable timer 27 periodically causes rotation of the shaft 1 until the number of teeth of the gear 2 set by the count set control 24 has passed by the sensor 23a at which time the rotation of the input shaft 3a and the shaft 1 is stopped and the brake 11 is set. At the same time, the output signal from counter 21 is transmitted by way of a line 30 to the control 28 thereof to deenergize the counter 21 in preparation for the next energization thereof by the timer 27.

If desired, a known type of audible or visible alarm 31 may be included to provide an alarm when the shaft 1 fails to rotate and hence, when the counter 21, etc., have not responded to the action of the timer 27. For example, the output signal of the timer 27 may be supplied to a latching relay 32 by way of a line 33 which is also connected to the counter output signal line 25 by way of a line 34. The timer 27 activates the relay 32 and causes it to latch whereas a signal from the line 25 releases the relay 32.

Activation of the relay 32 initiates operation of a known type of time delay device 35, such as a time delay relay which does not close its contacts for a period of time greater than the time of rotation of the shaft 1 but less than the time of two rotations of the shaft 1, and if the relay 32 is not unlatched by the expiration of such time delays, the time delay device operates the alarm 31.

A further supervision of the rotation of the shaft 1 can be provided by a recorder 36 which, for example, may be a known type of recorder having a chart or strip which is moved and on which the pulses from the detector 23 are marked. Thus, the rate at which the chart or strip is moved is a measure of time and the markings caused by the pulses indicate the rotation of the shaft 1 with the passage of time.

In operation, after the rotation of the shaft 1, and hence, the gear 2, has stopped following the discontinuance of the normal energy for rotating the shaft 1, e.g. the discontinuance of the supply of steam to the turbine blades on a shaft 1, the motor 9 is activated by the switch 14 and the timer 27 is activated. Assuming that the timer 27 does not provide an output signal, e.g. close its contacts for about 20 minutes thereafter, the shaft 1 will remain in a fixed position for about 20 minutes at which time the counter 21 will be activated, the brake 11 will be released and the motor 9 will be coupled to the input shaft 3a through the unit 10 causing rotation of the shaft 1. The amount that the shaft 1 will be then rotated depends upon the pulse count set by the count set control 24.

Let it be assumed that the gear 2 has 160 teeth. If the counter 21 is set to provide a signal output when 80 teeth have passed the sensor 23a then, when the shaft 1 has rotated 180°, the counter will provide a signal on line 25 which will set the brake 11 and release the coupling between the motor 9 and the shaft 3a by way of the unit 10. The shaft 1 will remain in its new position until the timer provides another start signal, e.g. after 20 minutes, when the shaft 1 will again be rotated through another 180°.

With the motor 9 operating, the shaft 1 can be continuously rotated, such as for turbine start-up, or may be rotated by small amounts independently of the counter 21. Also, if desired, the shaft 1 can be rotated 360° or less under the control of the counter 21 for various maintenance purposes.

For example, if it is desired to rotate the shaft 1 continuously, switches 26 and 37 are opened and the switch 22 is closed to release the brake 11 and to couple the motor 9 to the shaft 3a which will cause the shaft 1 to rotate as long as the switch 22 is closed. If the switch 22 is released, the shaft 1 will stop its rotation shortly thereafter.

However, if the new desired rotational position of the shaft 1 is known, the number of teeth 8 between the static position of the shaft 1 and the new desired position can be counted and set into the counter 21 by the count set unit 24. With the switches 26 and 27 closed, the contacts of the timer 27 are closed to cause the responses described hereinbefore and to cause the shaft 1 to rotate only an amount determined by the number of teeth set into the counter 21 and into the new selected position. When the shaft 1 has reached its new rotational position, it is desirable to open at least the switch 37 to prevent undesired further rotation of the shaft 1 by reason of action of the timer 27.

While a preferred embodiment of the invention has been described, it will be apparent to those skilled in the art that components other than those described and components differently connected may be used to accomplish the functions described. Furthermore, while the invention has been described in connection with the unique problems involved with the rotation of a turbogenerator shaft, it will be apparent that the invention is applicable to the rotational positioning of other shafts.

What is claimed:

1. A method of rotating a shaft of a machine during the time that the machine is not in normal operation, said shaft being subject to distortion when it remains stationary and non-rotating for a predetermined length of time, said method comprising:

at spaced time intervals, rotating said shaft by shaft rotating means between positions in which the shaft is stationary;

initiating the rotating of said shaft between said positions with settable timing means which initiates the rotating of the shaft at times spaced apart less than said predetermined length of time; and measuring the rotation of said shaft as it rotates between said positions and terminating the rotation of said shaft when the shaft rotates from one said position to another said position different from said one said position.

2. Method as set forth in claim 1 wherein said shaft rotating means comprises a rotatable gear with teeth and wherein the rotation of said shaft is measured by counting the number of teeth of said gear passing by a fixed point as said gear is rotated.

3. Method as set forth in claim 1 wherein said shaft rotating means comprises a motor and clutch means connected to said motor and wherein said motor is continuously operated and said clutch means is operated at said spaced apart times to couple said motor to said shaft and cause said motor to rotate said shaft.

4. Method as set forth in claim 3 wherein said shaft rotating means comprises a rotatable gear with teeth and wherein the rotation of said shaft is measured by counting the number of teeth of said gear passing by a fixed point as said gear is rotated and wherein said clutch means is operated so as to decouple said motor from said shaft when the number of said teeth which have been counted corresponds to rotation of said shaft by substantially 180°.

5. Method as set forth in claim 1 wherein said times are spaced apart in the range from about 15 to about 30 minutes.

6. Method as set forth in claim 1 wherein said shaft is continuously rotated at a speed in the range from less than 1 to about 3 revolutions per minute during said time intervals.

7. A method as set forth in claim 1 wherein said another said position is substantially 180° C. from said one position.

* * * * *